United States Patent [19]

Verslycken

[11] Patent Number: 4,906,034

[45] Date of Patent: Mar. 6, 1990

[54] EMERGENCY DOOR OPENING DEVICE

[75] Inventor: Alain Verslycken, La Ferté-sous-Jouarre, France

[73] Assignee: Constructions Electroniques de la Ferte-sousJouarre, SA, France

[21] Appl. No.: 210,734

[22] Filed: Jun. 23, 1988

[30] Foreign Application Priority Data

Jul. 9, 1987 [FR] France ..... 87 10005

[51] Int. Cl.[4] ..... E05B 65/10

[52] U.S. Cl. ..... 292/92; 292/21; 292/201; 292/DIG. 65

[58] Field of Search ..... 292/21, 92, 144, 153, 292/201, 210, DIG. 65

[56] References Cited

U.S. PATENT DOCUMENTS

| | | | |
|---|---|---|---|
| 2,910,858 | 11/1959 | Jackson | 292/92 X |
| 3,767,238 | 10/1973 | Zawadzki | 292/210 |
| 3,873,141 | 3/1975 | Peterson | 292/92 X |
| 3,945,670 | 3/1976 | Peterson | 292/92 |
| 4,081,980 | 4/1978 | Hightower | 292/21 |
| 4,540,208 | 9/1985 | Logan, Jr. et al. | 292/201 X |
| 4,752,092 | 6/1988 | Faust | 292/201 X |

FOREIGN PATENT DOCUMENTS

| | | | |
|---|---|---|---|
| 2591645 | 12/1985 | France . | |
| 214862 | 5/1941 | Switzerland | 292/201 |

*Primary Examiner*—Gary L. Smith
*Assistant Examiner*—Michael J. Milano
*Attorney, Agent, or Firm*—Laff, Whitesel, Conte & Saret

[57] ABSTRACT

A locking and unlocking device for opening an emergency exit in which an anti-panic bar is supported, at its ends, by two arms rotating in housings fastened by their bottoms on the leaf of the exit, on each side of the bar, one of the housings including the actual lock and the other including a horizontal finger extension from a lever of the anti-panic bar on the other side of the axis of rotation of the lever toward the bottom of the housing, a slide supported on the finger and vertically movable, whose front upper edge has the shape of a step, the side of the step being almost vertical and the base of the step slightly inclined forward, a transverse rod movable between a rear position where it abuts against the side of the step, slightly above its base, when the slide is in a low position, and a forward position where it is in front of the slide, a return device being provided for the rod in the forward position, the transverse rod being carried by the lower arms of lateral small rods rotating about a transverse axle situated above the transverse rod in or immediately in front of the same vertical plane, when it is in the rear position, the small rods comprising lateral arms directed toward the rear, a two-pronged fork whose base is connected to the armature of a solenoid fastened in the housing, the free ends of the two prongs working together with the lateral arms of the small rods to bring the armature into a rear position against the side of the step when the solenoid is energized, and a part of the slide clamping the operated state of microcontacts when the slide leaves its low position.

24 Claims, 5 Drawing Sheets

Figure 1:
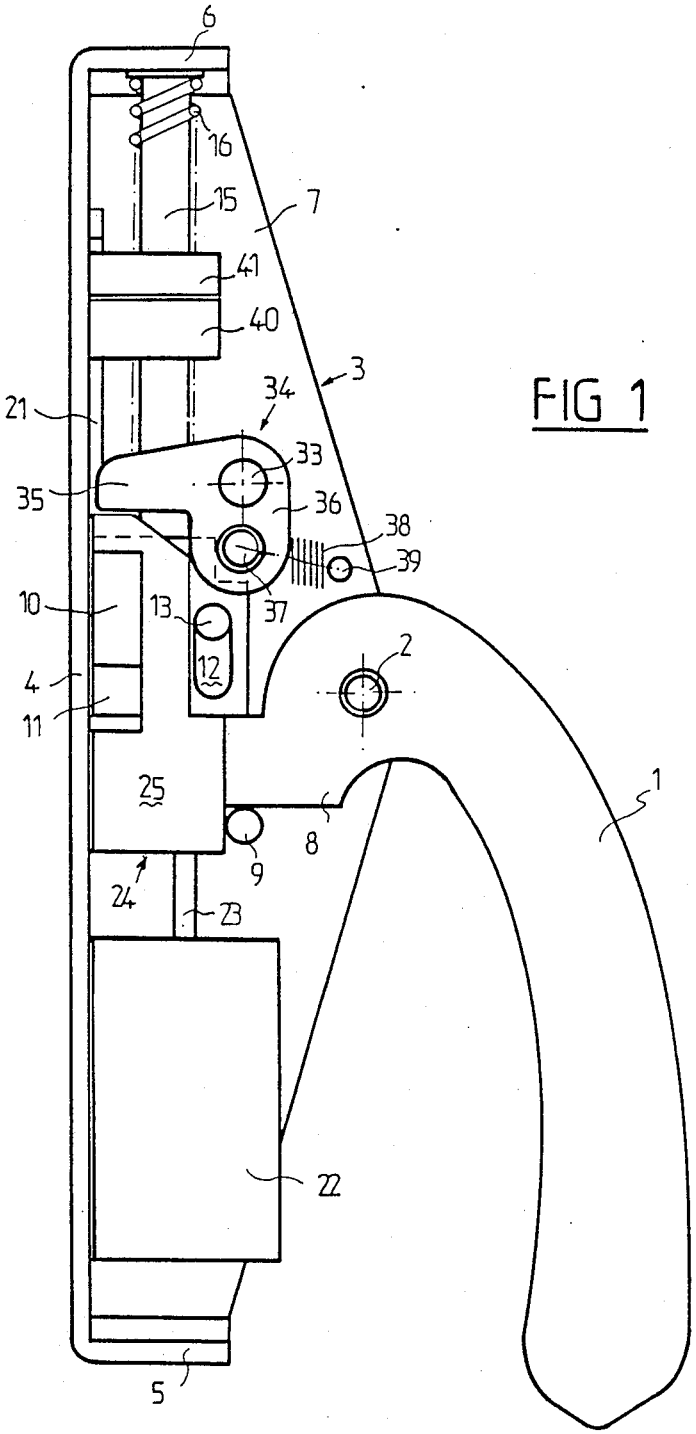

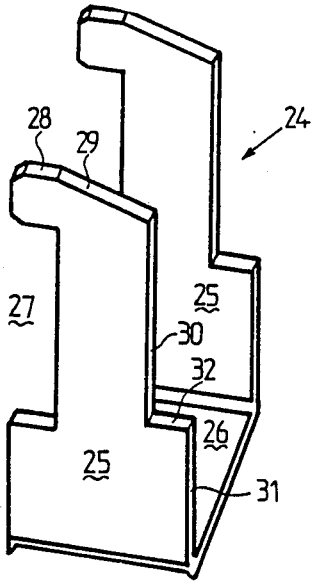
FIG. 7
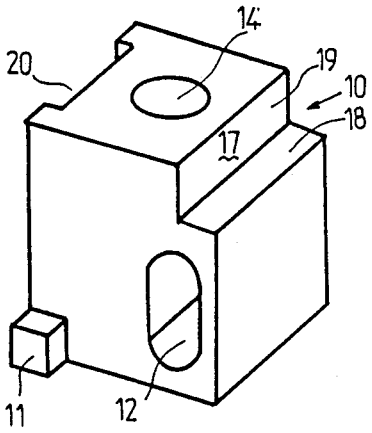
FIG. 6
FIG. 5
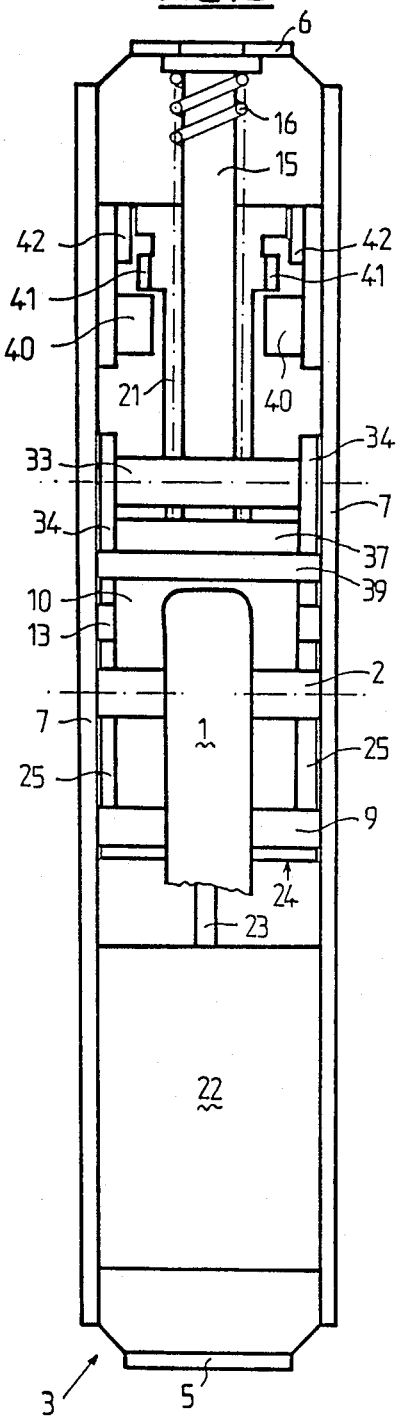

EMERGENCY DOOR OPENING DEVICE

The present invention relates to a locking and unlocking device as a means for opening an emergency exit and, more particularly, a device that is mounted on an exit which is subject to an electronic control and surveillance system.

Emergency exits of establishments open to the public are provided with opening devices, and generally with anti-panic bars which should unlock those exits when pushed by a person in order to quickly evacuate the public in case of an accident, such as a fire. However, in storesm, these opening devices cannot be used without a special surveillance device; otherwise the exits would also be open for the illegal removal of merchandise or entry of people.

That is why most often, in places of business, emergency exit openers are kept locked by electrical means, such as a live electromagnet. These means can be controlled from a central station or by heat or smoke detectors, etc. For greater security, the unlocked position of the opening device corresponds to the absence of a current in the electrical means.

The locking and unlocking device used must respond to a set number of conditions. On the one hand, when it is in the unlocked position, it is essential that it does not jam when it is given a command to open. It happens, for example, that a push force is exerted continuosuly on the anti-panic bar. This push, important in itself, should not in any case bar the unlocking of the device. Conversely, the latter should be able to resist, at best, if violent pushes are imparted on the anti-panic bar with an intent to force it. Moreover, the resistance of the device, as its capacity to unlock, must be assured by mechanical means and not be dependent on the force of the electromagnet, because the latter should consume as little energy as possible. Indeed, many electronic surveillance systems are used as anti-intrusion systems after business hours, for example, in stores. Generally, for security reasons, these systems are energized by batteries after business hours. The batteries must, therefore, have a life of at least seventy-two hours which represents the duration of a long weekend. Accordingly, it is necessary to provide these systems with elements which consume as little energy as possible.

On the other hand, the device should be able to generate signals requesting the exit to be opened as soon as a push, no matter how light, is exerted on the anti-panic bar, the signals being processed by the electronic surveillance system to inform the central station to release the delay switches before opening, etc.

An object of the present invention is to provide a device which meets all these requirements and which, moreover, is simple, solid and easy to install.

In the opening and closing system comprising the device of the invention, the anti-panic bar is supported, at its ends, by two arms pivoting in housings fastened at their bases on the [leaf] door of the exit on each side. One of the housings contains the actual lock, while the other contains the device used in the invention.

According to an embodiment of the invention, the device is comprised of: a horizontal finger extension from a lever of the anti-panic bar on the other side of its axis of rotation toward the bottom of the housing, a slide supported on the finger which is vertically movable, whose front upper edge has the shape of a step, the side of the step being almost vertical and the base being slightly inclined forward, a transverse rod which is movable between a rear position, where it abuts against the side of the step, slightly above its base, when the slide is in a low position, and a forward position, where it is in front of the slide, a return device provided for the transverse rod in the forward position, the transverse rod being carried by the lower arms of the small lateral rods rotating about a transverse axis situated above the transverse rod, in, or immediately in front of, the same vertical plane, when it is in the rear position, said small rods comprising lateral arms directed toward the rear, a two-pronged fork whose base is connected to the armature of a solenoid fastened in the housing, the free ends of the two prongs working together with the lateral arms of the small rods to bring the transverse rod into a rear position against the side of the step when the electromagnet is energized, and an integral part of the slide changing the operated condition of microcontacts when the slide leaves its low position.

According to another embodiment, the integral part of the slide has two arms acting on two microcontacts connected to an electronic surveillance system by two independent lines.

According to another embodiment of the invention, the slide is mounted in a sliding manner on a member in the vertical axis which is an integral part of the housing.

According to another embodiment of the invention, the inclination of the base of the step is between approximately 12° and 15°.

According to another embodiment of the invention, the slide has a horizontal transverse hole, having an oblong section directed vertically, in which a guide rod which is an integral part of the housing is engaged.

According to another embodiment of the invention, the prongs of the fork are plates parallel to the lateral walls of the housing, whose rear sides have an opening, and the slide has stops on its lateral sides, which are engaged in the openings.

According to another embodiment of the invention, the electromagnet is in the lower part of the housing and the lateral arms of the rods are supported on the prong tops of the fork.

According to another embodiment of the invention, a transverse abutment limits the downward displacement of the arm finger of the anti-panic bar.

According to another embodiment of the invention, the abutment and the guide rod engaged in the slide hole form, with the bottom of the housing on each side, vertical guides in which the prongs of the fork are engaged.

Figure 2:
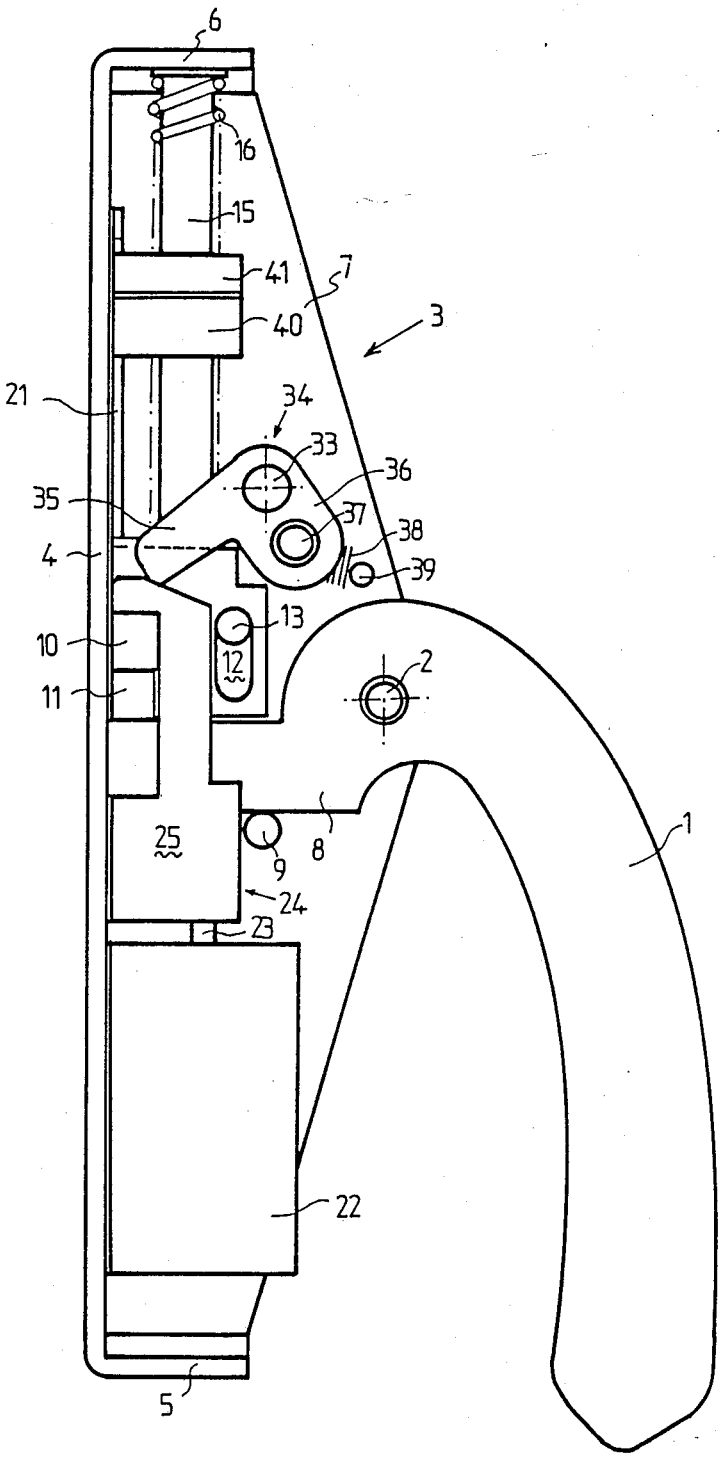
Figure 3:
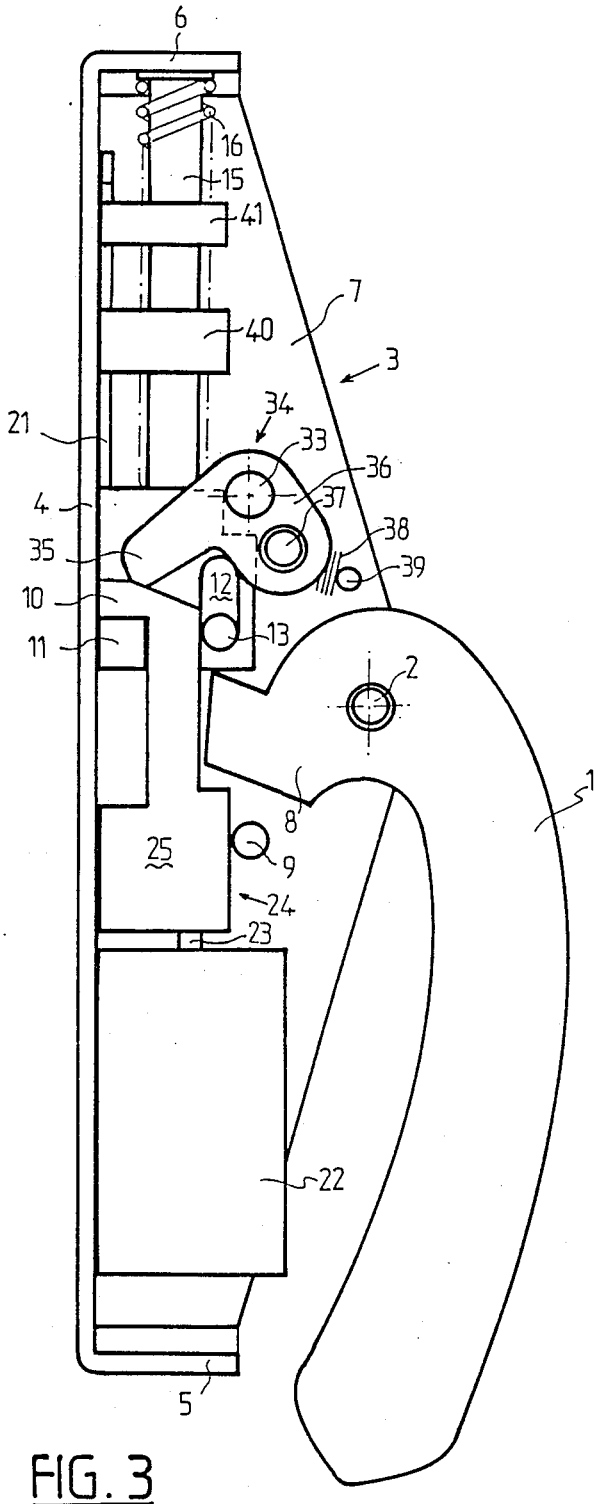
Figure 4:
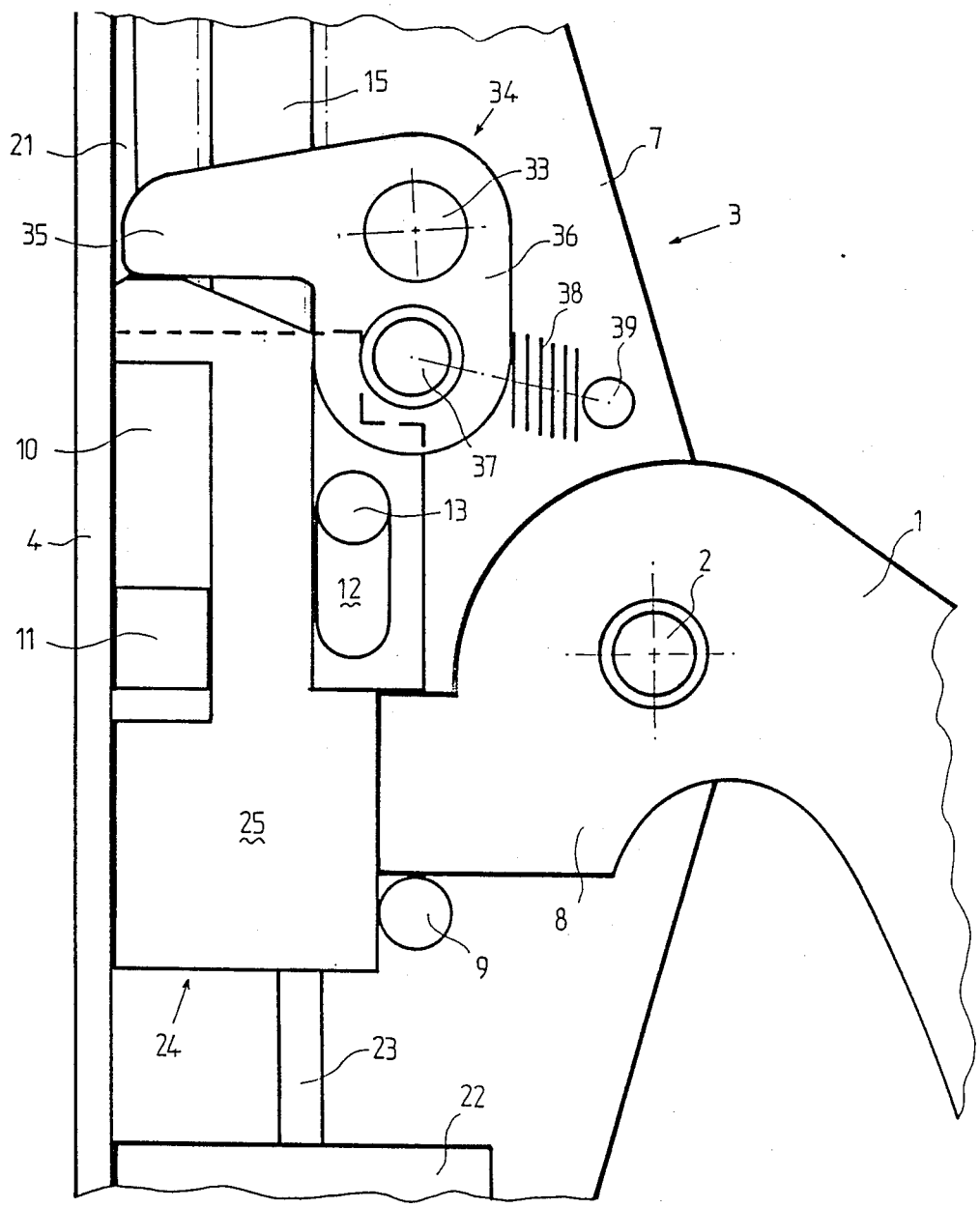

The above-mentioned embodiments of the invention, as well as others, will be more clearly understood upon reading the following description of a preferred embodiment of the invention, the description being made with reference to the accompanying drawings, in which:

FIG. 1 is a schematic side view showing a preferred embodiment of the blocking device of the anti-panic bar according to the invention, in a locked position, FIG. 2 is a view identical to FIG. 1, showing the device in an unlocked position without the anti-panic bar being actuated, FIG. 3 shows the device when the anti-panic bar is pushed into an opening position of the exit, FIG. 4 is an enlarged side view of the essential part of the device of FIGS. 1 to 3, FIG. 5 is a front view corresponding to FIG. 1, and FIGS. 6 and 7 are perspective views of the essential parts of the device shown in FIGS. 1 to 5.

The anti-panic bar, which is not shown, is supported at each end by an arm such as 1, the two arms rotating about a same horizontal axis. At rest, the arms are directed diagonally downward, the anti-panic bar being held between their lower ends. The pivot 2 of arm 1 is located in a housing 3 placed on one side of the exit door and contains the locking device of the anti-panic bar, and the pivot of the arm on the other side is in a housing containing the actual lock.

The housing 3 comprises a vertical base or plate 4, FIGS. 1 to 4, with lower and upper horizontal returns, 5 and 6 respectively, of the lateral walls 7 and a front cover, which is not shown. In FIGS. 1 to 4, the lateral front wall has been removed to show the device. For the same reason, the front cover has been removed in FIG. 5 and the lever 1 is only partly shown.

Pivot 2 of lever 1 is mounted between the two lateral walls 7 of housing 3. With respect to pivot 2, lever 1 is extended toward the bottom 4 of the case by a finger 8. At rest, finger 8 is approximately horizontal, as shown in FIGS. 1 and 2. Its lower side is propped against an abutment 9 in the form of a horizontal pin held between the walls 7.

A slide 10, shown in detail in FIG. 6, rests on the upper side of finger 8. The slide 10 has the general shape of a rectangular parallelepiped. Its lower corners adjacent to the bottom 4 have stops 11 projecting on its lateral sides, as shown in FIG. 6. In the illustrated embodiment, stops 11 have an almost square section, but it could have a completely different shape, for example, circular. Close to the side opposite bottom 4, the slide 10 is transversely crossed by a horizontal hole 12. Hole 12 has an oblong section in the vertical direction. A horizontal guide rod 13, mounted between walls 7, whose diameter is just a little less than the size of hole 12, is threaded into hole 12. Another hole 14, having a circular section, vertically passes through the slide 10 in its middle part. Slide 10 is threaded via hole 14 on a vertical guide axis 15 fastened to the upper return 6 of bottom 4. A spring 16, which draws the slide back downward, is provided about the axis 15 between the upper slide wall 10 and the return 6.

The upper front horizontal edge, opposite bottom 4, of slide 10 is cut in such a way as to form a step 17 whose base 18 is slightly inclined toward the front in relation to the horizontal and whose side 19 is vertical. In a satisfactory embodiment, the slope of the base 18 is approximately 12°. Finally, the rear side of slide 10 contains, in its middle part, a vertical groove 20, which is large enough and not very deep.

The base of a microcontact abutment 21, which will be described below, is lodged in the groove 20. The base of abutment 21 is fastened to the slide 10 by means of one or more screws.

The lower part of housing 3 includes the main part of a solenoid 22, whose armature 23 is directed vertically upward. Armature 23 becomes an integral part of a fork 24, shown in detail in FIG. 7.

Seen from the front, in FIG. 5, fork 24 has a general U shape with two vertical prongs 25 joined by a transverse base 26. The prongs 25 are flat plates parallel to the lateral walls 7 of housing 3. The base 26 is a horizontal flat plate. In practice, prongs 25 and base 26 are one piece, which is obtained by cutting and folding.

Base 26 is approximately rectangular, slightly smaller than the space between the lateral walls 7 of housing 3. The space between the walls 25 is slightly greater than the size of slide 10 between its lateral walls, but less than the size between the outer sides of the stops 11.

Seen from the slide, in FIGS. 1 to 4, prongs 25 have a particular outline. Their rear side, next to bottom 4, includes an oblong opening 27 whose sides are horizontal and whose bottom is vertical. The depth of opening 27 is about equal to the size of stops 11. The lower side of the opening 27 is approximately at one third of the height of prong 25 when the upper side is close to the top. The top of prongs 25 includes, from the back to the front, a horizontal part 28, then a part which is inclined toward the front 29. The side in front of prongs 25 is formed by two vertical segments 30 and 31, the lower vertical segment 31 being further in front than the upper segment 30. The segments 30 and 31 are separated by a horizontal shoulder 32 which is slightly higher than the lower side of opening 27.

Fork 24 is interconnected with rod 23 of the electromagnet by its base 26. Each prong 25, as shown in FIG. 5, is practically in contact with the adjacent lateral wall 7. The upper part of each prong 25 passes between the adjacent wall 7 and the corresponding lateral side of slide 10. Stop 11 of the latter is engaged in opening 27. The rear side of prong 25 is supported on the bottom 4 of housing 3. At the front, the upper segment 30 is in contact on the horizontal rod 13, while the lower segment 31 is in contact on abutment 9. The bottom 4 of housing 3, the rod 13 and abutment 9, thus, constitutes a vertical guide for fork 24. Of course, finger 8 of lever 1 is smaller than the space of the prongs 25 of fork 24 and can therefore pass through these.

Above step 17, a little in front of the latter, there is a horizontal transverse axle 33 set between the two walls 7. Two small rods 34 are rotatably mounted on axle 33, respectively close to each wall 7. The small rods 34 are flat and parallel to walls 7. They each have, at the rear of axle 33, an arm 35 which comes to rest on the top of the corresponding prong 25 of fork 24, then under axle 33, a larger arm 36. A horizontal transverse rod 37 is held between the lower arms 36. The lower arms 36 of the small rods 34 are drawn back to the front by springs 38 working on traction. Springs 38 are fastened on a horizontal transverse pin 39.

Arms 35 of the small rods 34 take a low position when fork 24 is itself in a low position, that is, when the solenoid 22 is not energized. When fork 24 is in a high position, the solenoid 22 being energized in this case, the arms 35 are also in a high position.

In a low position of the arms 35, FIG. 2, the lower arms 36 of the small rods 34 are drawn forward by springs 38. Rod 37, which is mounted between arms 36, is in front of the side before slide 10. In this position, the latter can be displaced upwardly under the action of finger 8 of arm 7. The anti-panic bar is unlocked and can, therefore, be pushed, FIG. 3. It should be noted that, in order that the anti-panic bar should not return to its rest position, the small rods 34 are not able to pivot, which is prevented by rod 37 which will abut against the side in front of the slide 10.

On the other hand, when the anti-panic bar is at rest, as shown in FIG. 2, the arms 35 of the small rods 34 can be raised by fork 24 by supplying the solenoid 22. To make the small rods 34 rotate, the solenoid 22 will only have to overcome the return force of the springs 38. When rotating, the arms 36 recoil and rod 37 comes to be positioned above step 17, propped against its vertical side 19 and at a slight distance from its base 18. It should be noted that, in this position, rod 37 is shifted slightly backward with respect to the axle 33 of the small rods 34. Slide 10 can then only be displaced very slightly when the anti-panic bar is required, after which base 18 of step 17 comes to rest against rod 37. As the latter is shifted backward with respect to axle 33, the push on the anti-panic bar is not transmitted to fork 24, nor then to the solenoid 22. On the other hand, if the solenoid 22 energy is cut while the anti-panic bar is pushed, as base 18 of step 17 is inclined, rod 37 will not be blocked toward the front and will even be able to retract.

The upper part of case 3 has two microcontacts 40 on each side. These microcontacts are controlled by abutment 21, which has already been mentioned, fastened to the rear of slide 10. Abutment 21 has a flat, vertical rod which shifts on the bottom 4 of case 3 and, at the upper end of the latter, it has two arms 41 in the form of returns directed toward the front. These are the arms 41 which act on two microcontacts 40, FIG. 5. Above the arms 41, abutment 21 has lateral extensions 42 taken between the guide plates 43 fastened to the lateral walls 7 of housing 3. It should be noted that the electronic surveillance system receives signals of the operated condition of the microcontacts 41 by independent lines; the system offers a double security which adds to its reliability.

Abutment 21 can also comprise, if necessary, a means for modifying the operated condition of another movement of the microcontacts when, once the device is unlocked, the anti-panic bar has been pushed and the slide 10 is in a high position, the signal produced signifies that the exit has been opened.

In a normal operational situation of the anti-panic bar system, the device of the invention is in a locked position, as in FIG. 1. The solenoid under tension maintains the finger 24 in a high position. Rod 37 between the small rods 34 is in a forward position, above the step 17 of slide 10. It is in contact with side 19 of the latter, but at a slight distance from the base 18. The arms 41 keep the microcontacts 40 open in the rest state.

If a push is exerted on the anti-panic bar, a slight displacement of slide 10 results, due to finger 8 of arm 1, until base 18 comes to test against rod 37. Rod 37 then simultaneously abuts against base 18 and side 19. As previously mentioned, it is then in the same vertical plane as axle 33 of the small rods 34, or slightly in front of it. In this way, a push on the anti-panic bar not only results in, via arms 35, a force against the solenoid 22 but, moreover, if the resulting force is not integrally transmitted to axle 33, its component, which tends to make the small rods 34 turn, will exert itself in the same direction as the force of the solenoid 22. The resistance of the device to violent pushes on the anti-panic bar will then not be dependent on the power of the solenoid. The parts 33 to 37 should be provided with an appropriate mechanical resistance.

In its slight upward displacement, slide 10 draws abutment 21 along, the arms 41 of the abutment close the microcontacts 40 which produce two independent signals which are processed by the electronic surveillance system. In practice, the latter can release an alarm to the central station, as well as the start of a delay at the end of which, if no human intervention has taken place, the energy to the electromagnet 22 is cut. Fork 24 then descends and frees the arm 35 of the small rods 34 downward. Rod 37 is then subjected only to the forward return force of the springs 38 and, if the push is exerted on the anti-panic bar, to the motion of the forces applied by the side and the base of the step 17 and to the passing reaction force by axle 33. In any case, the result of these forces should have a component directed forward so that the rod 37 can be effectively retracted toward the front as soon as finger 24 descends, namely, as soon as the solenoid energy is cut. It is, moreover, necessary that the forward displacement of rod 37 can take place without the slide 10 having to descend, even if very slightly. This condition is fulfilled by providing the base 18 is inclined forward. An incline in the range of 12 to 15 degrees is sufficient.

The device being unlocked, the anti-panic bar can be pushed until the exit is opened. Rod 21, by arms 41 or other arms, can act on other microcontacts to deliver a signal indicating its opening.

From an open position, the device can only be returned to a locked state if slide 10 has descended completely again. This implies, on the one hand, the anti-panic bar is returned to its rest position as in FIG. 1 and that, on the other hand, slide 10 does not remain blocked. Spring 16 is thus designed sufficiently powerful so that such an incident cannot occur. It should be noted that the return to the low position of slide 10 returns the microcontacts to the rest state. Their change of state could be taken into account by the electronic surveillance system which will be able to indicate if the device can be locked again or not.

I claim:

1. A locking and unlocking device for opening an emergency exit having a door with an anti-panic bar supported at its ends by two arms, said two arms being mounted and rotating about an axis of rotation in housings fastened at their bottoms on said door, one of the housings including a lock and the other of the housings including:

a horizontal finger extending from a lever on the anti-panic bar, said finger being on a side of the axis of rotation of the lever which is opposite said anti-panic bar and placed toward the bottom of the housing, a vertically movable slide supported on said finger, a front upper edge of said slide having a step with a side and a bottom, the side of the step being almost vertical and a base of the step being slightly inclined forward, a transverse rod which is mounted for movement between a rear position where it abuts against the side and slightly above the base of said step when the slide is in a low position, and a forward position where said transverse rod is in front of the slide, a return device associated with said slide for acting on said rod when it is in the forward position, said transverse rod being carried by the lower arms of lateral small rods which are mounted to rotate about a transverse axis situated above said transverse rod when said transverse rod is in the rear position, said small rods comprising lateral arms directed toward the rear, a solenoid in said housing, said solenoid having an armature, a two-pronged fork having a base which is connected to the armature of said solenoid, free ends of the two prongs working together with the lateral arms of the small rods to bring said transverse rod into a rear position against the side of said step when the armature is energized, and at least one set of microcontacts, a part of the slide changing the operated state of said microcontacts when the slide leaves a low position in its vertical movement.

2. A device according to claim 1, in which said part of the slide is comprised of two arms acting on two of said microcontacts connected to an electronic surveillance system via two independent lines.

3. A device according to claim 1 or 2, in which the slide is mounted to move in a sliding manner along a vertical guide formed by part of the housing.

4. A device according to claim 1 or 2, in which the incline of said step is between approximately 12 and 15 degrees.

5. A device according to claim 1 or 2, in which the slide bar has a horizontal transverse hole with a vertically directed oblong section, a guide rod which is an integral part of the housing being engaged within said hole.

6. A device according to claim 1 or 2, in which the prongs of the fork are plates which are parallel to lateral walls of the housing, rear sides of said fork plates having openings, the slide having stops on its lateral sides which are engaged in the openings.

7. A device according to claim 1 or 2, in which the solenoid is in a lower part of the housing, the lateral arms of the small rods being supported on the tops of the prongs of the fork.

8. A device according to claim 1 or 2, and a transverse abutment for limiting a downward displacement of the finger of the lever of the anti-panic bar.

9. A device according to claim 8, in which the slide has a horizontal transverse hole with an oblong section, a transverse abutment, a guide rod which is an integral part of the housing being engaged within said hole, the transverse abutment and the guide rod engaged in the hole of the slide forming vertical guides in which the prongs of the fork are engaged.

10. A device according to claim 3, in which the incline of said step is between approximately 12 and 15 degrees.

11. A device according to claim 3, in which the slide has a horizontal transverse hole with a vertically directed oblong section, a guide rod which is an integral part of the housing being engaged within said hole.

12. A device according to claim 4, in which the slide has a horizontal transverse hole with a vertically directed oblong section, a guide rod which is an integral part of the housing being engaged within said hole.

13. A device according to claim 3, in which the prongs of the fork are plates which are parallel to lateral walls of the housing, rear sides of said fork plates having openings, the slide having stops on its lateral sides which are engaged in the opening.

14. A device according to claim 4, in which the prongs of the fork are plates which are parallel to lateral walls of the housing, rear sides of said fork plates having openings, the slide having stops on its lateral sides which are engaged in the opening.

15. A device according to claim 5, in which the prongs of the fork are plates which are parallel to lateral walls of the housing, rear sides of said fork plates having openings, the slide having stops on its lateral sides which are engaged in the opening.

16. A device according the claim 3, in which the solenoid is in a lower part of the housing, the lateral arms of the small rods being supported on the tops of the prongs of the fork.

17. A device according to claim 4, in which the solenoid is in a lower part of the housing, the lateral arms of the small rods being supported on the tops of the prongs of the fork.

18. A device according to claim 5, in which the solenoid is in a lower part of the housing, the lateral arms of the small rods being supported on the tops of the prongs of the fork.

19. A device according to claim 6, in which the solenoid is in a lower part of the housing, the lateral arms of the small rods being supported on the tops of the prongs of the fork.

20. A device according to claim 3, and a transverse abutment for limiting a downward displacement of the finger of the lever of the anti-panic bar.

21. A device according to claim 4, and a transverse abutment for limiting a downward displacement of the finger of the lever of the anti-panic bar.

22. A device according to claim 5, and a transverse abutment for limiting a downward displacement of the finger of the lever of the anti-panic bar.

23. A device according to claim 6, and a transverse abutment for limiting a downward displacement of the finger of the lever of the anti-panic bar.

24. A device according to claim 7, and a transverse abutment for limiting a downward displacement of the finger of the lever of the anti-panic bar.

* * * * *